US005367835A

United States Patent [19]

Turnbull

[11] Patent Number: 5,367,835

[45] Date of Patent: Nov. 29, 1994

[54] POLISHER

[75] Inventor: Richard W. Turnbull, Halifax, Great Britain

[73] Assignee: Crawford-Swift Limited, Claremont - Halifax, England

[21] Appl. No.: 30,050

[22] PCT Filed: Sep. 13, 1991

[86] PCT No.: PCT/GB91/01568

§ 371 Date: Jun. 21, 1993

§ 102(e) Date: Jun. 21, 1993

[87] PCT Pub. No.: WO92/05013

PCT Pub. Date: Apr. 2, 1992

[30] Foreign Application Priority Data

Sep. 21, 1990 [GB] United Kingdom ..... 9020651.7

[51] Int. Cl.[5] ..... B24B 21/02

[52] U.S. Cl. ..... 451/5; 451/307

[58] Field of Search ..... 51/145 R, 284 R, 165.71, 51/227 R, 165 R, 281 P

[56] References Cited

U.S. PATENT DOCUMENTS

| | | | |
|---|---|---|---|
| 2,573,220 | 10/1951 | Riedesel | 51/145 R |
| 2,901,871 | 9/1959 | Kluge, Jr. | 51/145 |
| 3,149,441 | 9/1964 | Hess | 51/147 |
| 3,488,891 | 1/1970 | Kissling | 51/145 R |
| 4,886,529 | 12/1989 | Hashimoto et al. | 51/165.71 |

FOREIGN PATENT DOCUMENTS

| | | | |
|---|---|---|---|
| 3716688 | 12/1987 | Germany . | |
| 0304114 | 6/1971 | Sweden | 51/145 R |
| 1399083 | 5/1988 | U.S.S.R. | 51/165.71 |

*Primary Examiner*—Robert A. Rose

*Attorney, Agent, or Firm*—Reising, Ethington, Barnard, Perry & Milton

[57] ABSTRACT

A polishing apparatus (10) comprises a main arm (12) mounted for horizontal and vertical movement. The arm (12) is provided with a rotating belt (32) of abrasive material for polishing purposes. An article to be polished, for example a dished end is mounted on a table drive (24). The arm (12) carries an X–Y plate (28) including a contact wheel (30) movable relative to the arm (12) along two orthogonal axes. Cylinders (38, 40) bias the contact wheel toward the article to be polished. In use, the arm (12) is swept across the radius of the dished end so as to "map" the profile to be polished and thereafter the arm (12) follows this profile at a preset "off-set" of 50–75 millimeters. Minor irregularities of the surface are "ridden" by the X–Y plate (28) against the constant bias of the pneumatic cylinder without being ground away.

8 Claims, 4 Drawing Sheets

POLISHER

This invention relates to polishing apparatus and in particular to such apparatus for polishing the dished heads of processing vessels.

Processing vessels used in industries such as food, pharmaceutical and chemical industries often have the requirement that all contact surfaces must be thoroughly cleanable. This is achieved by polishing the contact surfaces of the vessel. Many such vessels are constructed by rolling prepolished flat plate into a cylinder then welding one dished head on either end and inserting the various necessary inlet/outlet pipes and manways. It is the dished heads of a vessel which incur the greatest time and expense in achieving a finish comparable to that of the rolled sections of the cylinder. Such dish heads have in general always been finished by hand which is very costly and time consuming, as well as dirty, noisy and tedious for the personnel carrying out the work.

The invention seeks to provide an apparatus capable of polishing such dished ends automatically.

According to the present invention there is provided a polishing apparatus which comprises a main arm mounted for movement in horizontal and vertical directions, the arm being provided with a rotating belt of abrasive material for polishing purposes, and means for mounting and rotating a dish to be polished characterised in that the arm carries a mechanism, including a contact wheel, movable relative to the arm along two orthogonal axes and an associated pneumatic cylinder providing biasing force.

The invention further comprises a method of polishing a dished end which comprises placing a dished end in the above apparatus, moving the arm so that one radius of the dished end is followed by the contact wheel, storing the trajectory in memory, raising the arm a fixed amount above the dished end surface, and traversing the arm from the center to the periphery and back repeatedly while the dished end is rotated, pressure being applied to the contact wheel by the pneumatic cylinder in accordance with information stored in the memory.

The apparatus and method of the invention allow dished ends to be accurately polished quickly and simply without resorting to manual methods. The machine may be used for a variety of dished ends of different sizes one after another since in each case it simply "maps" a single radius of the dished end and stores this in memory for the subsequent polishing operation. A unique feature of the invention is that minor irregularities which are bound to occur in such objects as dished ends are compensated for through the "offset" mechanism as described more fully hereinafter.

The mechanism, or "X-Y plate", is movable relative to the main arm in two axes. It is urged towards the surface to be polished and therefore urges the contact wheel carrying the abrasive belt into contact with the surface to be polished, by means of a pneumatic cylinder. The travel of the pneumatic cylinder is arranged such that it has sufficient stroke as to be greater than any of the irregularities in the surface likely to be encountered. This means that although the main arm will follow a fixed path according to the radius stored in memory the X-Y plate, and abrasive contact wheel, can "ride" irregularities while maintaining a constant pressure of the belt on the surface. In this way, the surface is smoothly polished and yet irregularities are allowed for without having to map the entire surface. The fact that only a single radius needs to be "mapped" means that this operation takes only a few seconds rather than many minutes or hours as with certain programmable grinding machines.

It will be appreciated that the apparatus of the invention can also be used for grinding operations, i.e. where the surface finish of the workpiece is initially too rough for final polishing. This may be accomplished by employing successive belts of increasingly fine abrasive material up to and including the final polishing stage. This process is known as "finishing."

The invention will be described further, by way of example, with reference to the accompanying drawings, in which.

Figure 1:
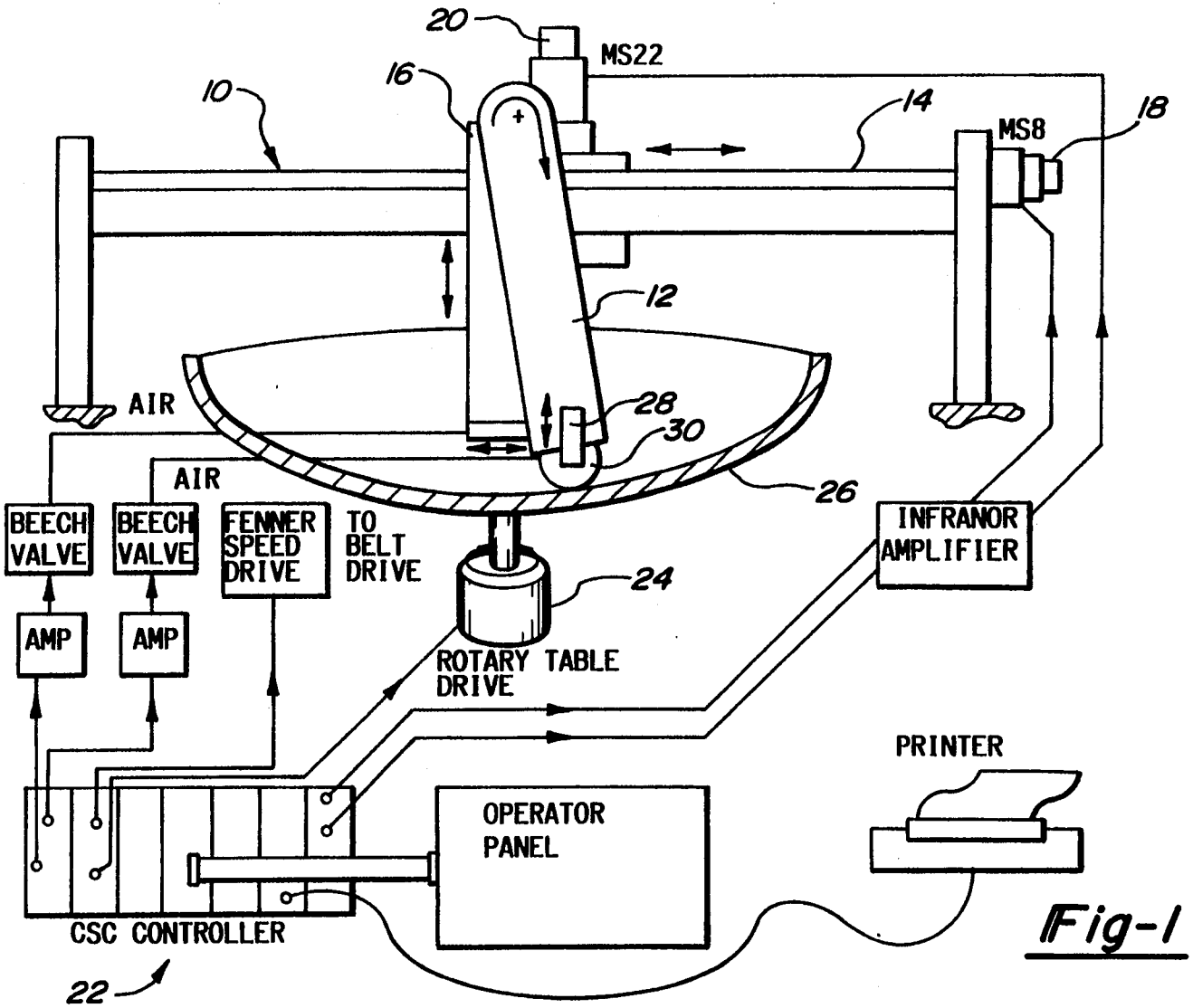
FIG. 1 is a diagramatic representation of the apparatus of the invention together with its control circuits.
Figure 2:
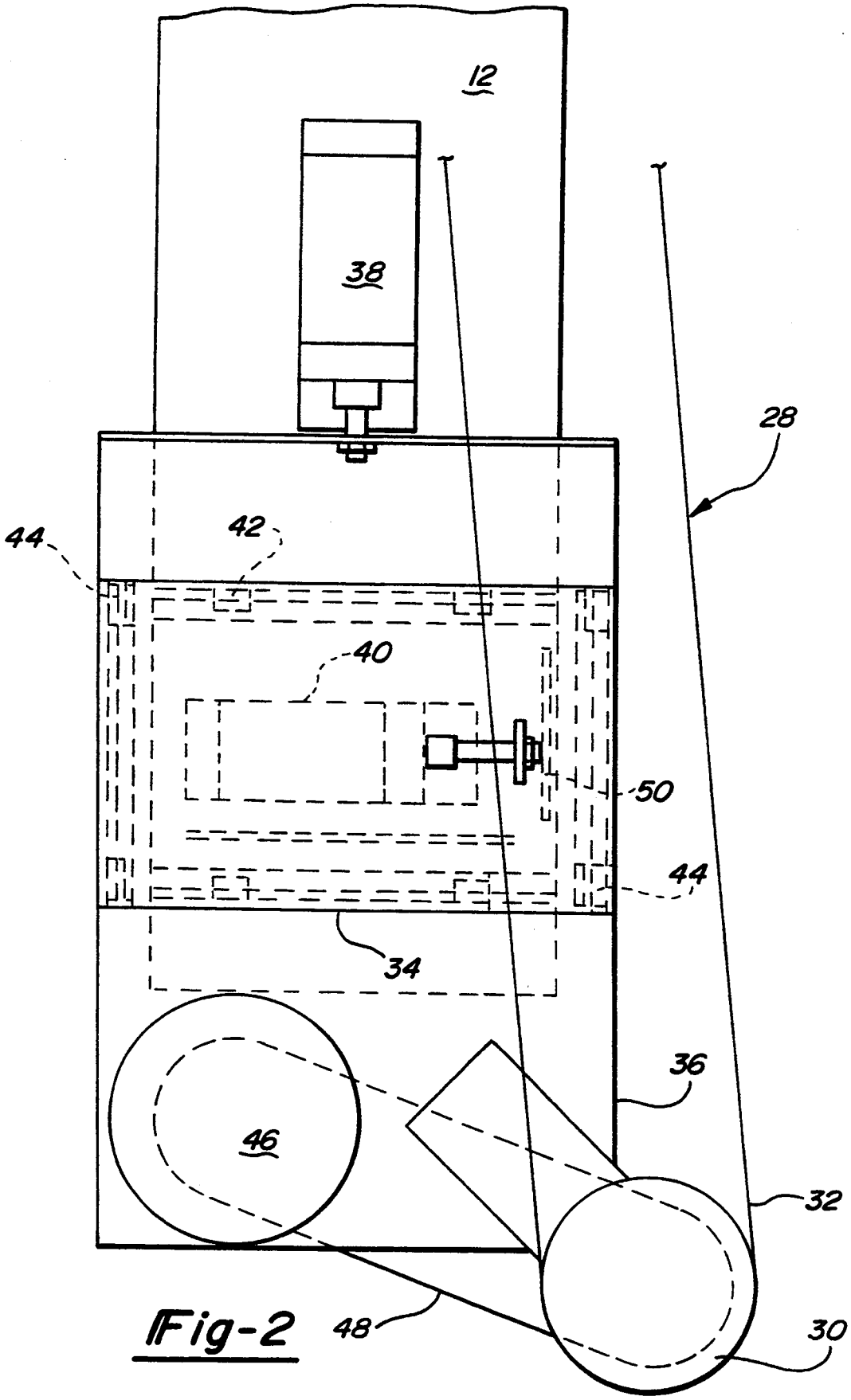
FIG. 2 is a more detailed diagramatic representation of the contact wheel mechanism.

Referring to the drawings, in particular FIGS. 1 and 2, the polishing apparatus generally designated 10 comprises a main arm 12 mounted on a crossbar 14 for horizontal movement and a pillar 16 for vertical movement. The actual movement is effected by means of servo motors 18, 20 controlled by a CSC controller 22. Below the arm 12 is a rotary table 24 on which may be mounted a dished end 26 to be polished.

Main arm 12 carries at its lower extremity a contact wheel mechanism, or "X-Y plate", 28. The latter is shown in more detail in FIG. 2. The X-Y plate has a contact wheel 30 over which an abrasive belt 32 runs. The top of the belt 32 passes round a suitable idler pulley (not shown) on the top of the arm 12 and rotates to polish the surface of the dish 26.

The X-Y plate 28 comprises a vertically adjustable plate 34 and a horizontally adjustable plate 36. The contact wheel 30 is mounted on the latter. Each plate is moved and controlled by an associated pneumatic cylinder 38 and 40 respectively. The plate 36 is mounted for movement in horizontal linear bearings 42 and the plate 34 is mounted in vertical linear bearing 44. A drive motor 46 and associated drive belt 48 are provided for the contact wheel 30. Vertical/horizontal digital encoders 50 are associated with each of the plates 34 and 36.

In use, a dish 26 is placed on the rotary table 24 and the main arm moved to the central position on its horizontal beam 14 and lowered until the drive wheel 30 is in contact with the inner surface of the dished end 26. The arm is then moved vertically and horizontally keeping the drive wheel 30 in contact with the surface so that it traces out a radius from the centre of the dish to the outer periphery. The digital encoders 50 send information to the controller 22 so as to store the locus of movement of the contact wheel during this operation. This, in effect, "maps" the radius of the dish 26 to be polished. Since the dish is symmetrical mapping one radius provides sufficient information for polishing the entire dish. The machine is then switched to "polish" mode at which point the rotary drive 24 rotates the dish 26 while the arm 12 reciprocates from the center to the outer periphery with the belt 32 running thereby polishing the internal surface of the dished end. Since the area toward the centre of the dish will be traversed more often by the abrasive, the pressure of the abrasive belt 32 (as applied by the contact wheel 30) can be progressively reduced from the outer periphery towards the centre in accordance with a programme stored in the controller. By this means a substantially uniform amount of material will be removed from across the entire surface.

A unique feature of the apparatus of the invention is the way in which it copes with minor irregularities of the surface. Since no dished end or head 26 is going to be completely uniform and symmetrical, mapping of a single radius and storing this in memory will only give an approximately accurate path to follow. This is taken care of by the "offset" feature in which, after the initial mapping, the main arm is raised a fixed amount, for example from one to three inches, above the surface of the dish 26. This "offset" is taken up by moving the X–Y plate 28 downwardly until the contact wheel 30 once again causes the abrasive belt 32 to contact the surface. The pressure is applied to the surface by the cylinders 38 and 40 within the X–Y plate mechanism reacting against the position of the main arm 12. The stroke of the cylinders 38 and 40 is chosen to be sufficiently great, so as to be more than any irregularity which will be encountered. Since pneumatic cylinders operate at substantially constant pressure irrespective of the degree of extension, at any given point in reciprocating movement, the belt 32 is held by the contact wheel 30 at the programmed pressure irrespective of the exact position of X–Y plate with relation to the main arm 12. Thus irregularities in the surface of the dished end 26 are simply ridden over by the contact wheel 30 while maintaining the programmed pressure on the surface throughout. If it were not for this feature lumps or irregularities might simply be ground away in many cases producing holes in the dish 26. The main arm 12 follows the stored profile at the set offset height with the linear bearings 42, 44 allowing the contact wheel on the X–Y plate to remain in contact with the dished end.

Figure 3:
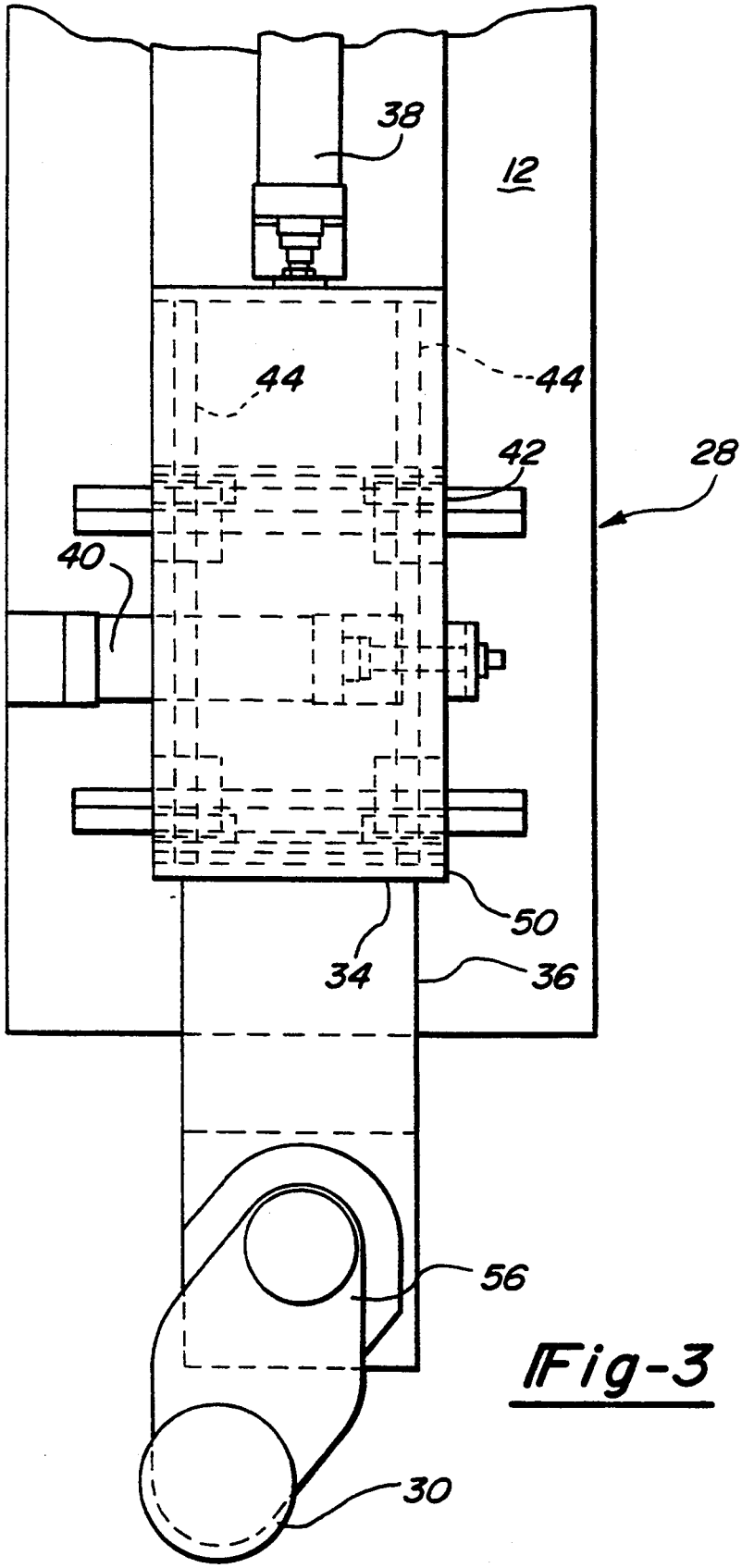
FIG. 3 is a similar view of FIG. 2 of another embodiment.
Figure 4:
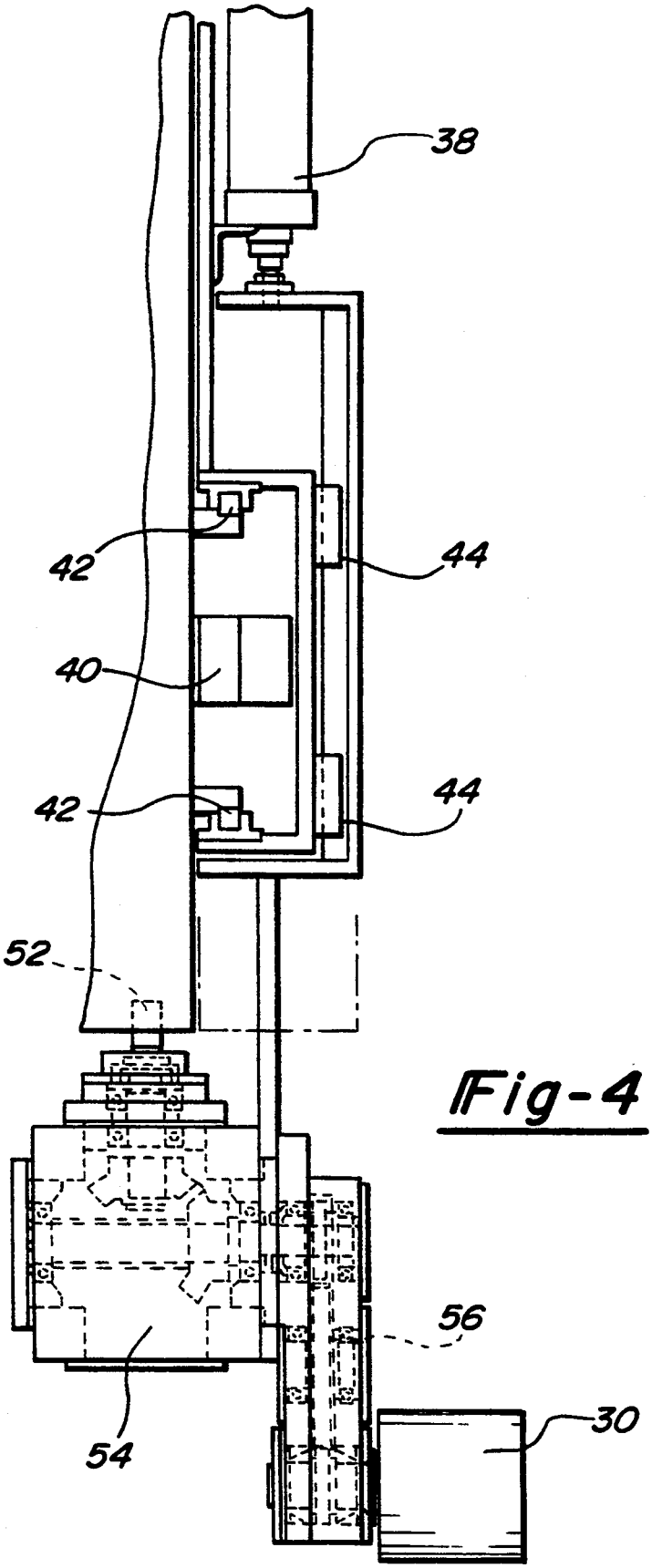
FIG. 4 is a side view (partly in section) corresponding to FIG. 3.

Referring now to FIGS. 3 and 4, and using like numerals for like parts a preferred embodiment of the X–Y plate 28 is illustrated. In this, the belt drive 48 is dispensed with and motor 46 is not mounted on the X–Y plate itself. Instead, a motor is mounted on the frame of the apparatus and is driven via a splined and universally jointed shaft 52 passing into a right angled drive box 54 which in turn is connected to a drop gear box 56. The wheel 30 is driven from the drop gear box 56. In addition, in this embodiment, the gear box 56, and its associated contact wheel 30, can be mounted as shown (with its longitudinal axes at 20° left of the vertical) or can be mounted in the mirror image position (with its longitudinal axes mounted 20° right of the vertical). This allows the wheel to be positioned easily for either left or right movement on either internal or external profiles. In addition it allows two two cutting heads (16) to be mounted on one gantry (14) to enable opposite halves of the dish to be polished simultaneously and thus half polishing time for a given dish.

There are several advantages to the embodiment shown in FIGS. 3 and 4. Firstly, removing the weight of the drive motor 46 lowers the inertia of the X–Y plate assembly and enables the contact wheel to follow the surface more truly; secondly the splined shaft 36 can transmit more power than the drive belt 48 and thus a more powerful motor can be employed to give faster operation. Indeed, the additional power available in this modification enables it to be used not only for polishing but for the machining of complex profiles for example marine propellors. The desired profile of a finished propellor may be mapped as discussed above and stored in the memory. The apparatus may then work on a unmachined casting and will remove metal until it reaches the design profile. This clearly involves the removal of a greater amount of metal than a finishing operation, thus the requirement for the higher power. It should be noted that the operation of the apparatus of the invention, even in this end use, is different from conventional computer controlled machining operations in that the contact wheel follows the entire profile the whole time until it reaches its maximum extension (at which the "mapped" profile is followed). This ensures faster operation.

EXAMPLE

In a particular example the digitizing of a dished head surface is carried out as follows:

When tracing or "digitizing" a surface only one single radius of the dishes profile has to be recorded. The operation takes only a few seconds and the machine's design makes it unnecessary to map the entire surface due to a mechanism which automatically follows unmapped undulations in the surface. This allows for different configurations of dishes and cones to be processed quickly and accurately, since only one single radius needs to be mapped in each case.

In operation the main vertical column (12) is instructed to lower until the contact wheel meets the surface and the small y axis of the unit 28 (y) assumes a mid position relative to the column 12 axis y1. This is known by the computer receiving information via the linear encoders on the smaller axis. A nominal pressure is applied to the pneumatic cylinders in order to keep the contact wheel on the surface of the work piece. The main vertical column (Y1) is then sent across the surface. The computer is programmed to match the position of the main vertical column with that of y2, keeping the small x axis x2; mid position relative to y2 so that if y2 moves (+1)—Y1 moves (+1)
y2 moves (−3)—Y1 moves (−3)
y2 moves (−2)—Y1 moves (−2), etc The computer not only matches Y1 with y2 but records all the relative positions of all the axes of the machine through the servo motors and the linear encoders and thereby a detailed picture of the surface's profile is built up. Multiple passes allow a three dimensional picture to be formed, just like an Ordinance Survey Map. The rate of sampling can be varied to give greater or less detail. The x2 axis senses and instructs the computer when vertical faces are being digitised.

Once the profile has been recorded of, say, a dished head, the computer moves the X1/Y1 axis in a fixed profile path above the surface of the dish. The offset is taken up by the x2/y2 axis with the main vertical column following the same profile as the dish. The pneumatic cylinder can apply a force to the contact wheel by acting against the main vertical column Y1. However, when an undulation is met by the contact wheel elsewhere on the dish the smaller x2/y2 axis moves over the undulation without the main vertical column changing its path.

There are end of travel switches on the x2/y2 axis, just in case of an undulation being greater than the length of travel allowed.

The polishing apparatus of the invention may be used on other items than dished ends or heads but is particularly useful in relation thereto. It can, for example, be used on flat plates, or on convex rather than concave surfaces. With a modified form of the apparatus of the invention large diameter tubes can be polished or finished. In this the tube is mounted below the arm 12 and is arranged so as to be rotated about its axis and simultaneously translated in the axial direction. The arm 12 is maintained stationary and the "offset" as described above allows for any irregularities in the outer periphery of the tube. In this embodiment no "mapping" is required prior to operation.

However it use on the polishing of internal surfaces of dished ends for process apparatus enables a time consuming and expensive manual process to be automated and carried out much more quickly and cheaply as well as reliably. Moreover, the apparatus of the invention is extremely flexible in that it can be used successively on different articles as it does not need extensive programming for each new shape; indeed, apart from the initial samples of a single radius, no programming is normally required.

I claim:

1. A polishing apparatus which comprises a main arm movably mounted to a housing for movement in horizontal and vertical directions, the arm being provided with a contact wheel having abrasive material for polishing purposes, a drive mechanism for rotating said wheel for moving said abrasive material there along with said wheel and against an article to be polished, and means for mounting and rotating the article to be polished, said polishing apparatus characterized in that the arm carries a mechanism including the contact wheel, said mechanism including said wheel being slideably mounted to said arm for relative motion along two orthogonal axes, and an associated pneumatic cylinder providing biasing force along a respective orthogonal axis for biasing said wheel and abrasive material against the article.

2. An apparatus as claimed in claim 1 in which the mechanism is movable relative to the main arm in two axes, one substantially parallel to the longitudinal axis of the arm and one at right angles thereto in the plain of movement of the arm.

3. An apparatus as claimed in claim 2 in which movement in each of the two axis is controlled by an associated pneumatic cylinder.

4. An apparatus as claimed in claim 1 in which the travel of the pneumatic cylinder is arranged such that it has sufficient stroke as to be greater than any of the irregularities on the surface of the article likely to be encountered.

5. An apparatus as claimed in claim 1 in which the contact wheel is driven through a splined universally jointed drive shaft and a gear box.

6. A method of polishing an article which comprises placing the article in an apparatus as claimed in claim 1, moving the arm so that radius of the article is followed by the contact wheel, storing the trajectory in memory, raising the arm a fixed amount above the article surface, traversing the arm from the center to the periphery and back repeatedly while the article is rotated, pressure being applied to the contact wheel by the pneumatic cylinder while the arm moves in accordance with information stored in the memory.

7. A method as claimed in claim 6 in which the article to be polished is a dished end.

8. A method as claimed in claim 6 in which successive grades of increasingly fine abrasive material are employed so as to both grind and polish the article.

* * * * *